US009861125B2

(12) United States Patent
Fishpaw, Jr. et al.

(10) Patent No.: US 9,861,125 B2
(45) Date of Patent: Jan. 9, 2018

(54) HOLDER FOR CIGARS, AND THE LIKE

(71) Applicants: Richard E. Fishpaw, Jr., Johnston, RI (US); Robert A. Garde, Jr., Johnston, RI (US)

(72) Inventors: Richard E. Fishpaw, Jr., Johnston, RI (US); Robert A. Garde, Jr., Johnston, RI (US)

( * ) Notice: Subject to any disclaimer, the term of this patent is extended or adjusted under 35 U.S.C. 154(b) by 312 days.

(21) Appl. No.: 14/922,937

(22) Filed: Oct. 26, 2015

(65) Prior Publication Data

US 2016/0120217 A1 May 5, 2016

Related U.S. Application Data

(60) Provisional application No. 62/073,351, filed on Oct. 31, 2014.

(51) Int. Cl.
*A24F 13/02* (2006.01)
*A24F 19/00* (2006.01)

(52) U.S. Cl.
CPC ..... *A24F 13/02* (2013.01); *A24F 19/0064* (2013.01)

(58) Field of Classification Search
CPC ..... A24F 13/02; A24F 13/12; A24F 13/22; A24F 15/04; A24F 15/08; A24F 15/12; A24F 15/18; A24F 15/20; A24F 19/0035; A24F 19/0064
See application file for complete search history.

(56) References Cited

U.S. PATENT DOCUMENTS

| | | | | |
|---|---|---|---|---|
| 2,181,275 | A * | 11/1939 | Kaner | A24F 19/0064 131/242 |
| 4,838,285 | A | 6/1989 | Petrone | |
| 5,524,646 | A | 6/1996 | Reich | |
| 5,588,448 | A | 12/1996 | Photakis | |
| 5,595,194 | A | 1/1997 | Talbot | |
| D380,862 | S | 7/1997 | Hasselgren et al. | |
| D385,940 | S | 11/1997 | Justice | |
| 5,706,832 | A | 1/1998 | Gold | |
| D392,362 | S | 3/1998 | Ridgeway | |
| D392,770 | S | 3/1998 | Scallon et al. | |
| D393,923 | S | 4/1998 | Dimonekas | |
| 5,788,197 | A | 8/1998 | Tutela | |
| D398,713 | S | 9/1998 | Poosikian | |
| 5,826,589 | A | 10/1998 | Ohanian | |
| D405,224 | S | 2/1999 | Falconio | |
| 5,868,143 | A | 2/1999 | Nielsen | |
| 5,909,735 | A | 6/1999 | Knudsen | |
| 6,234,179 | B1 | 5/2001 | Alcaraz | |
| 6,363,941 | B1 | 4/2002 | Combs | |

(Continued)

*Primary Examiner* — Eric Yaary
(74) *Attorney, Agent, or Firm* — Barlow, Josephs & Holmes, Ltd.

(57) ABSTRACT

The present invention provide a new and novel holder for storing unlit articles to be smoked, such as cigar, and holding such articles when they are lit and not currently being smoked. When the holder is in a closed position, it acts as a carrying case for a number of articles to be smoked of any size (adjustable for lengths). When opened, the unit can be easily mounted to any frictional engagement device, such as a golf cart ball holder tray or easily with the cup-holder adapter. The device can also easily be applied to any cup holder typically found within golf carts, boats, and vehicles and any other structure that includes a cup holder.

14 Claims, 16 Drawing Sheets

(56) References Cited

U.S. PATENT DOCUMENTS

| | | | |
|---|---|---|---|
| 6,530,510 | B2 | 3/2003 | Ferrari |
| 6,962,536 | B2 | 11/2005 | Hall et al. |
| 7,000,617 | B2 | 2/2006 | Cervantes et al. |
| D563,042 | S | 2/2008 | Long |
| 7,387,127 | B1 | 6/2008 | Braun |
| 7,600,517 | B1 | 10/2009 | Holzrchter |
| 7,661,431 | B1 | 2/2010 | Barrios |
| D626,285 | S | 10/2010 | Adame |
| 8,439,768 | B1 | 5/2013 | Shah |
| 8,757,168 | B2 | 6/2014 | Wills |

* cited by examiner

HOLDER FOR CIGARS, AND THE LIKE

CROSS REFERENCE TO RELATED APPLICATION

This application is related to and claims priority from earlier filed provisional patent application Ser. No. 62/073,351, filed Oct. 31, 2014, and the entire contents thereof is incorporated herein by reference.

BACKGROUND OF THE INVENTION

The invention relates generally to holders for cigars and cigarettes. In particular, the present invention relates to holders for cigars to temporarily hold the cigar when it is lit but not currently being smoked. The present invention also relates to holders for storing cigars when they are not being smoked.

Such holders for cigars are well known in the art. For example, many devices are known in the industry where the lit cigar is held by the clip, stand or support while the base of the holder is clamped to the support, such as a golf cart.

There are a number of problems typically associated with these prior art holders. They must be clamped to a given structure, such as a vertical post of a golf cart frame. As a result, the lit cigar(s) are located in a position that could result in the players bumping into them causing a safety issue.

In view of the foregoing, there is a demand for a cigar holder that can be installed in a secure and safe location during golf game play. There is also a need for such a holder to be easily adapted to installation in other locations, such as into a cup holder, which may or may not be in a golf cart and which also may contain a bottom portion that serves as a receptacle to contain ashes for a clean area in a golf cart.

SUMMARY OF THE INVENTION

The present invention preserves the advantages of prior art holder and storage devices for cigars. In addition, it provides new advantages not found in currently available devices and overcomes many disadvantages of such currently available-devices.

The present invention provide a new and novel holder for storing cigars when not being smoked and holding lit cigars when they are not currently being smoked. When the holder is in a closed position, it acts as a carrying case for two cigars of any size (adjustable for lengths). When opened, the unit can be easily mounted to any golf cart which has a molded ball holder tray or easily with the cup-holder adapter; this device can also easily be applied to any cup holder typically found within golf carts, boats, and vehicles (cars and trucks) of all types or any structure that includes a cup holder. These trays are mechanical trays are folded outward to hold cigars when the cover is removed and during operation as an ashtray. When lit cigars are placed on the trays, the ash ends may be directed inwardly so that their falling respective ashes are directed into an integrated receptacle of the holder of the present invention.

The device of the present invention preferably includes molded plastic parts and possibly metal components (alternative design configuration) has multiple uses for a person who chooses to smoke cigars while golfing or other numerous activities such as driving, boating, and camping by providing a clean and efficient means for carrying to, holding while smoking, and maintaining the final cigar ends and resulting ashes in a simple convenient case.

It is therefore an object of the present invention to provide an improved cigar holder device.

Another object of the present invention is to provide a cigar holder that can be installed on a golf cart, namely into the ball tray or cup holder.

A further object of the present invention is to provide integrated support surfaces for at least one cigar.

Another objection of the present invention is to provide a base that serves as an ashtray to catch ash and receive cigar butts.

A further object of the present invention is to enable the storage of new unlit cigars in the form of a travel case.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
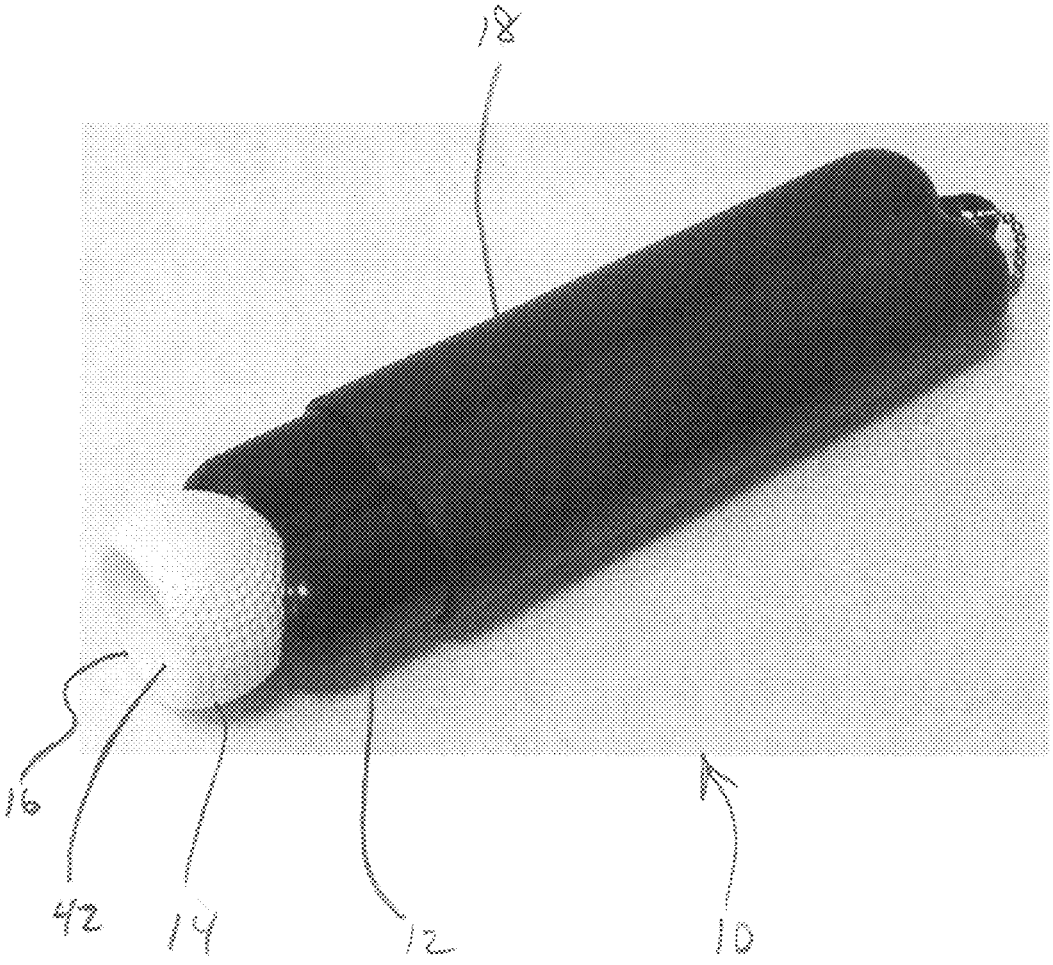
FIG. 1 is a perspective view of an exemplary embodiment of the present invention in a closed position for storage or transportation.

Turning first to FIGS. 1-13, an exemplary embodiment various views of the cigar holder 10 of the present invention is shown. The exemplary embodiment of the cigar holder 10 of the present invention is shown to include a base 12 with a ball-like engagement member 14, having a substantially flat bottom surface 16, attached to the bottom thereof. The cigar holder device 10 has a cover in the form of a main top case half 18 which is utilized when the device is functioning in the closed carry-case mode, which is seen in FIG. 1. This cover 18 can be easily removed to allow storage of two cigars 11 of any length/ring size within the inside of the device 10, as seen in FIG. 2.

Figure 2:
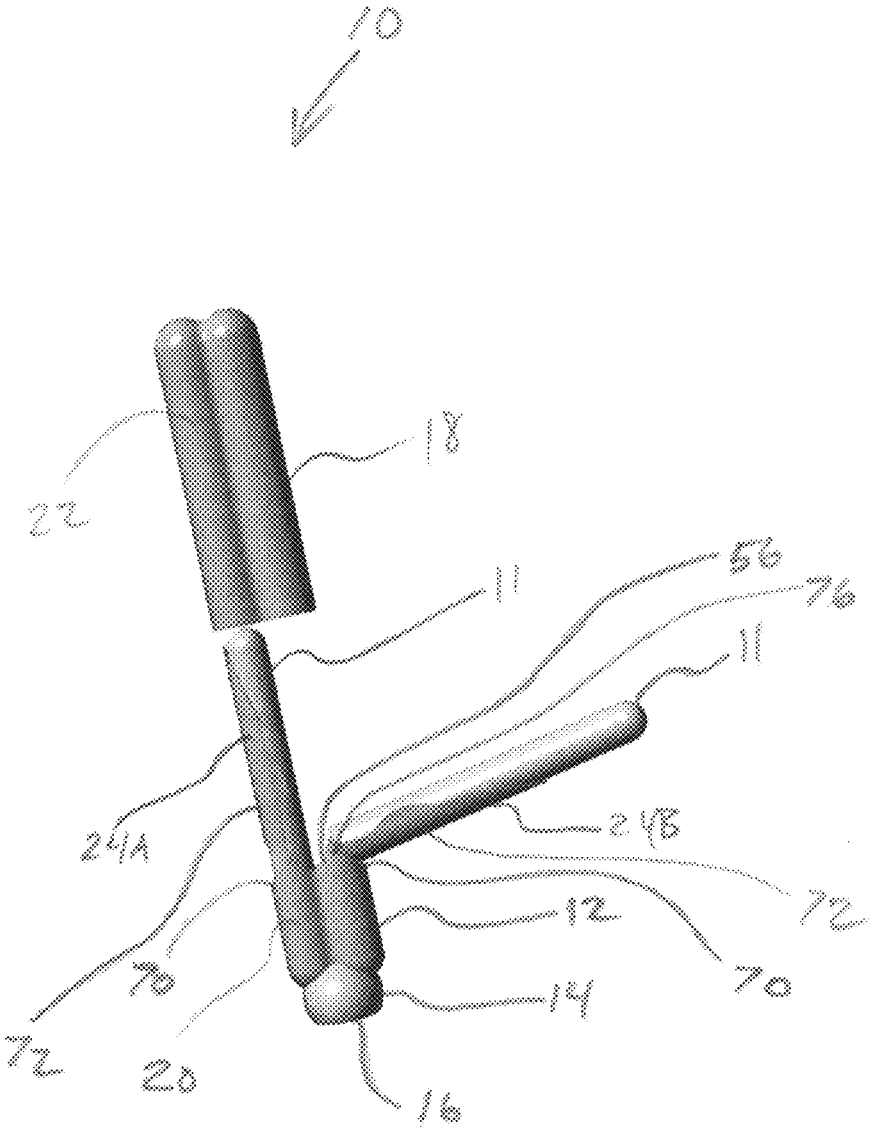
FIG. 2 is a perspective view of the exemplary embodiment of the present invention with the cover being removed from the base.

It can be seen in FIGS. 1 and 2 that the base 12 has an outer wall 20 and the cover has an outer wall 22 that each extend axially such that the base outer wall 20 and the cover outer wall 22 each have the profile of two conjoined parallel cylindrical tubes, which facilitates storage of two cigars 11 within the exemplary embodiment of the cigar holder device 10. The cover 18 is removed from the base 12 in FIG. 2 to reveal two cigars 11 that were contained within the cigar holder 10 in FIG. 1.

The exemplary embodiment of the cigar holder 10 includes two support trays 24A, 24B that are hingedly connected to the base 12. Other embodiments (not shown) may include more or fewer support trays. The use of less than or more than two trays that can accommodate fewer or more than two cigars is envisioned by the present invention.

The cover 18 is positionable over and about the at least one support tray 24A, 24B when the at least one support tray 24A, 24B is in the stored vertical closed orientation, as shown in FIG. 1, where the two support trays 24A, 24B are concealed within the cover 18 that is frictionally secured to the base 12. With the cover 18 removed in FIG. 2, the support tray 24A on the left is shown in the vertical closed orientation, while the support tray 24B on the right is shown rotated away from the vertical closed orientation. The cover 18 and the base 12 and trays 24A, 24B are preferably sold as a unit so that a multi-function device can be provided. As will be discussed in detail below, the trays 24A, 24B are an integrated feature of the cigar holder of the present invention and work in combination with the cover 18. When the cover 18 is installed, the cigar holder 10 works as a standard holder for cigars when cigars are not being smoked. When the cover is removed, the device 10 now works as a uniquely configured ashtray and cigar support while cigars are being smoked. Thus, the present invention provides multiple integrated functions from a single device 10.

Figure 3:
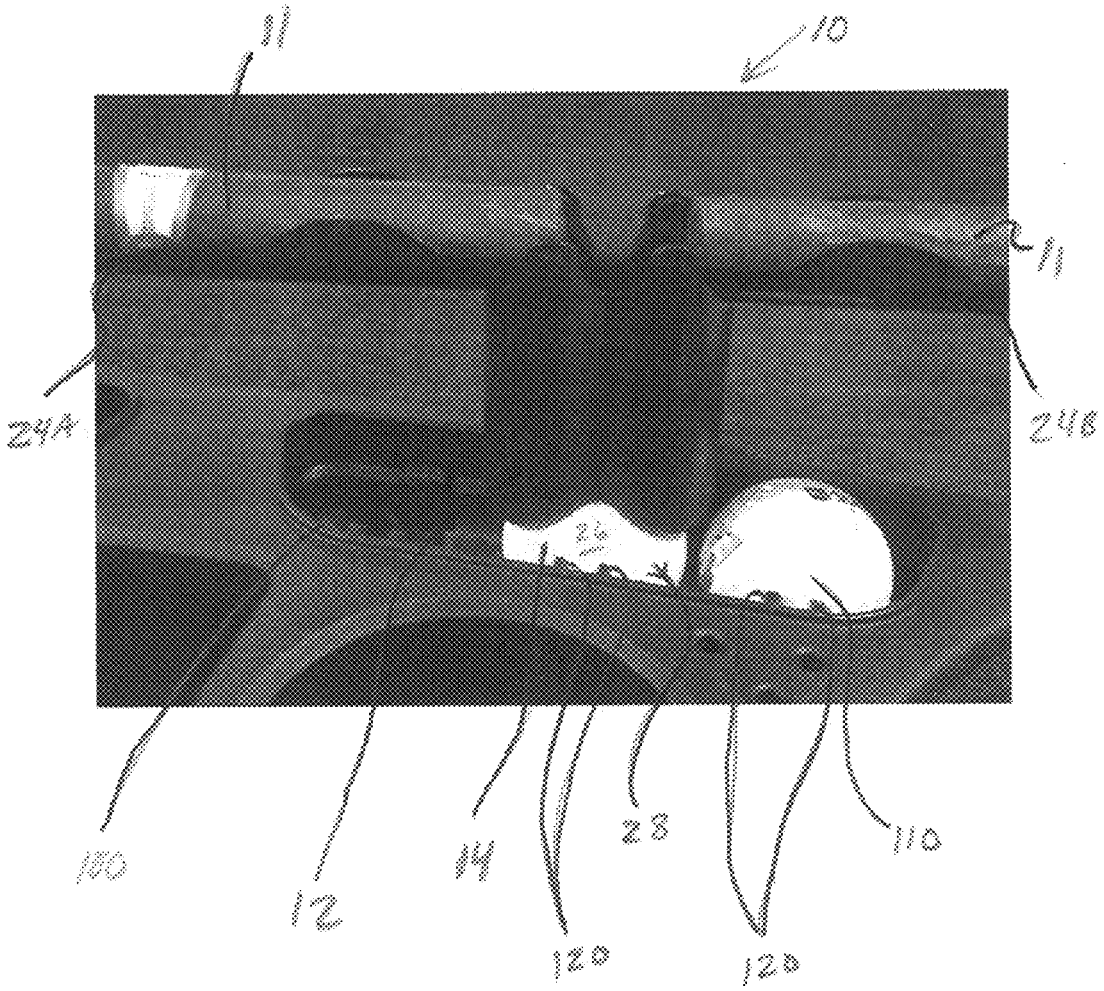
FIG. 3 perspective view of the exemplary embodiment of the present invention secured to a golf ball tray in a golf cart.

Each support tray 24A, 24B is pivotable about a hinge 76 between a stored vertical closed orientation and a horizontal open orientation. As noted above, the support tray 24A on the left in FIG. 2 is in the vertical closed orientation. FIG. 3 shows both support trays 24A, 24B in the horizontal open orientation, so that each support tray can support a cigar 11. With the base 12 extending vertically, each of the support trays 24A, 24B supports a cigar 11 so the cigar 11 extends horizontally. That is, each support tray 24A, 24B is substantially level with the ground when in the horizontal open orientation, and when the base 12 extends substantially vertically upward from the ground (or other support surface).

The support trays 24A, 24B of the device 10 can be maintained in the opened orientation by gravity or by mechanical springs. The hinged support trays 24A, 24B may be formed with an integrally molded hinge 76 for each support tray 24A, 24B. There are preferably two support trays 24A, 24B (left and right) but more or less than two support trays may be employed. Further, the base 12 is configured to allow the support trays 24A, 24B to fold to a preferably approximate fixed 90° orientation when fully opened relative to the vertical orientation when in the closed orientation of FIG. 1.

FIG. 3 shows how the cigar holder device 10 can be mounted in a golf ball tray 100, such as a golf ball tray 100 that is in a golf cart. The golf ball tray is known in the art, and is useful for frictionally engaging golf balls 110 therein.

The engagement member 14 further comprises a convex outer surface 26, and a plurality of dimples 28 defined on the convex outer surface 26, so that the engagement member 14 at least substantially has the appearance of a golf ball when it is mounted in the adapter 30 or received in a golf ball tray 100. Thus, the engagement member 14 is a ball-like engagement member 14 in the exemplary embodiment of the cigar holder 10. FIG. 3 shows the engagement member 14 received in and frictionally engaged with a golf ball tray 100, which are commonly found in golf carts. There is enough tension in the fingers 120 of the ball tray 100 to secure the holder 10 in place including while driving the golf cart. As a result of this unique installation and configuration of cigar holder 10, lit cigars 11 are now stored out of the way from knees and clubs and secured from rolling away and fully protected from the elements on the golf course. This avoids the butt ends being littered on to the golf course.

In FIG. 3 the cigar holder 10 is positioned next to an actual golf ball 110 that is received in the golf ball tray 100 for a point of reference and comparison of the outer surface 26 of the engagement member 14 with the appearance of the golf ball 110. The golf ball 110 is selected from any golf ball design that is currently commercially available or developed in the future. Thus, in various embodiments of the cigar holder 10, the outer surface 26 and dimples 28 can be configured to match any one of such golf balls. Most notably, the outer surface of engagement member 14 is configured to be of a similar shape to an actual golf ball 110 so that it frictionally engages in golf ball tray in similar fashion to actual golf ball 110.

Figure 4:
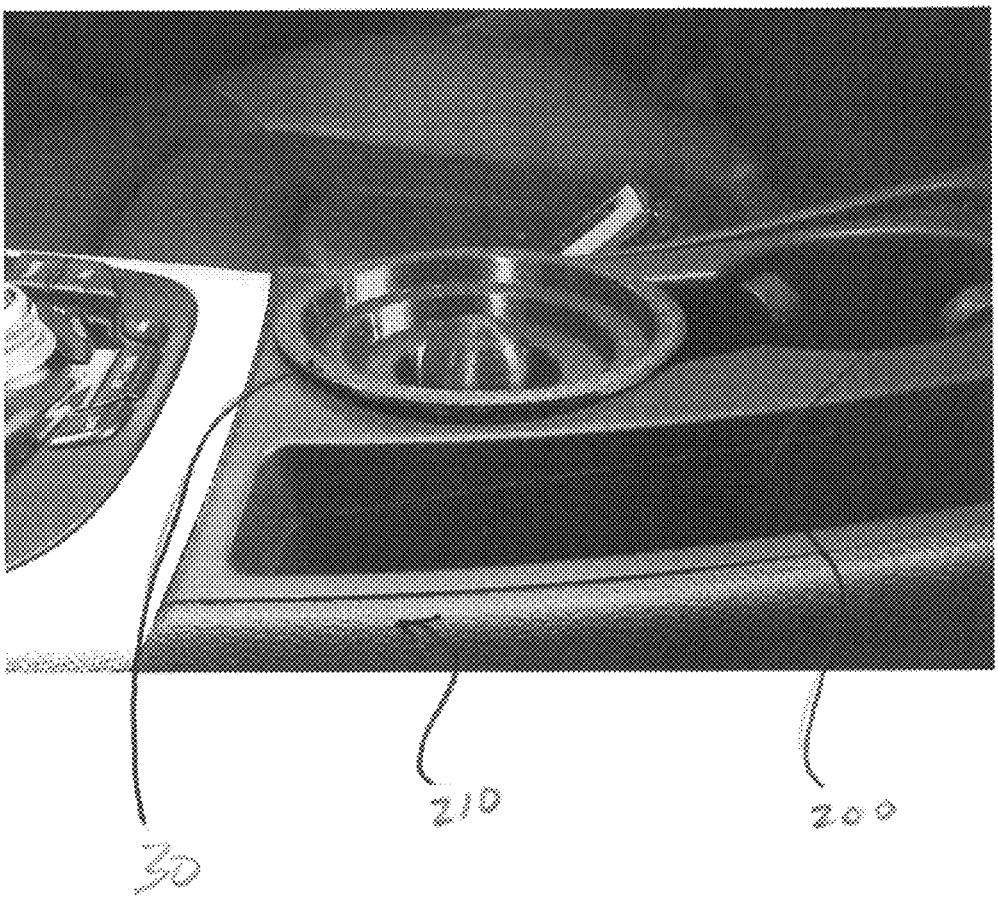
FIG. 4 is a perspective view of an adapter received in a cup holder.
Figure 5:
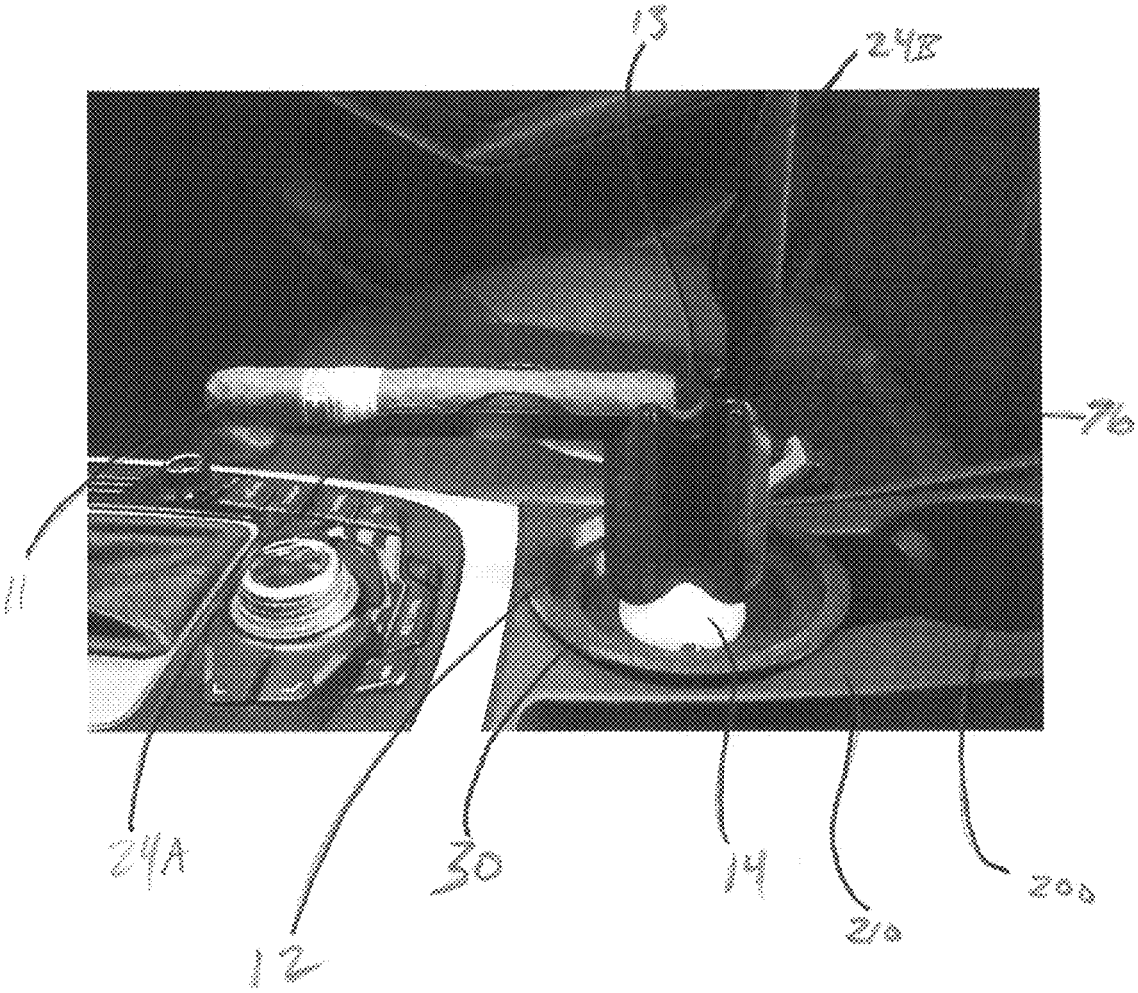
FIG. 5 is a perspective view of the exemplary embodiment of the present invention supported in a cup holder, with one support tray in the horizontal open orientation.
Figure 6:
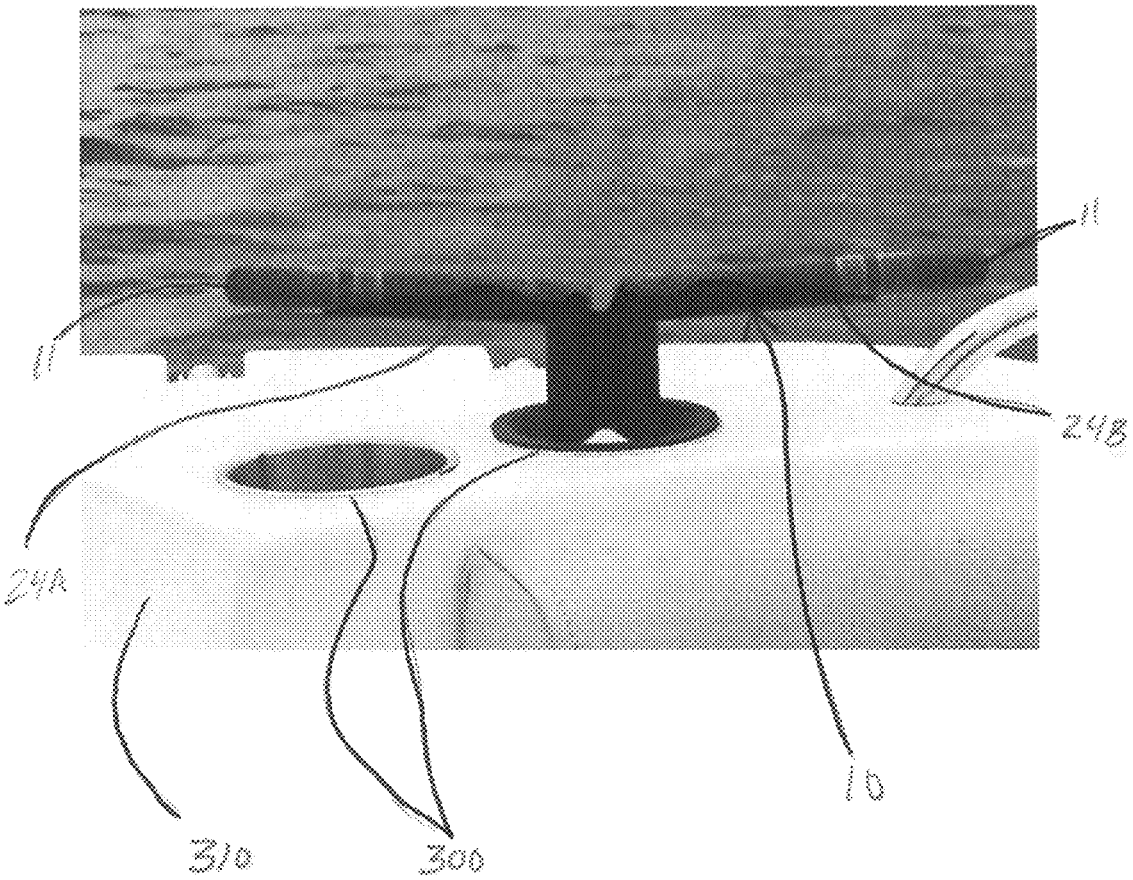
FIG. 6 is a perspective view of the exemplary embodiment of the present invention supported in a cup holder, with both support trays in the horizontal open orientation.

Referring to FIGS. 4-6, the exemplary embodiment of the cigar holder 10 the present invention includes a cup holder adapter 30 so that a consumer can use the cigar holder 10 of the present invention, for example, when the consumer has access to a cup holder but does not have access to a golf ball tray 100. The user can use the cup holder adapter 30 to support the cigar holder 10 in a cup holder, such as a cup holder 200 formed in the console 210 of an automobile, as shown in FIGS. 4-5, or such as a cup holder 300 formed in a boat 310, as shown in FIG. 6.

Figure 7A:
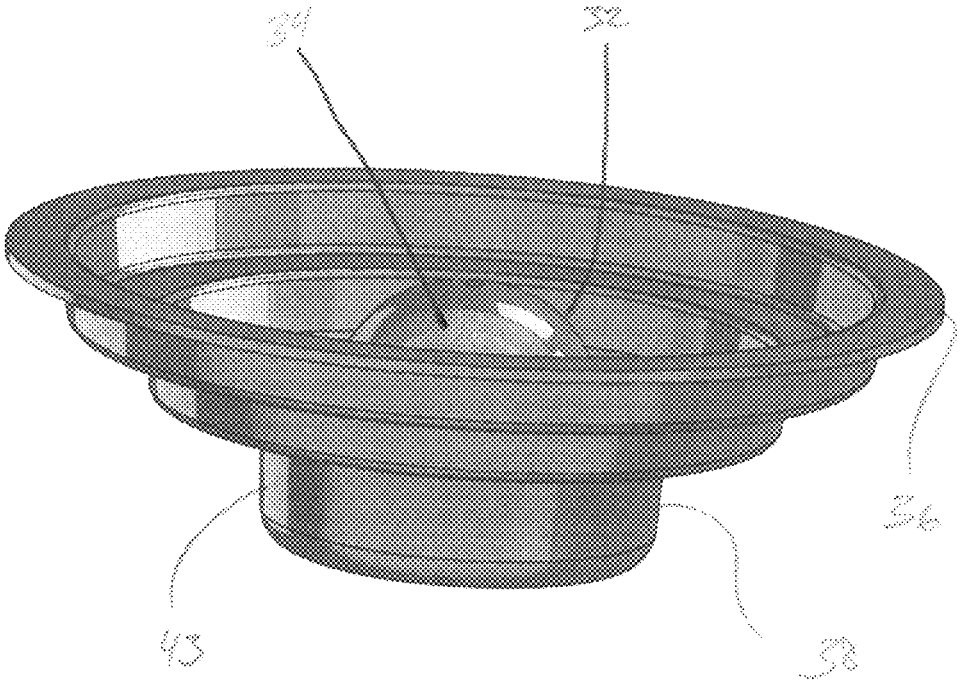
FIG. 7A is a perspective view of a first cup holder adapter.

Referring to FIG. 7A, in the exemplary embodiment of the cigar holder 10, the cup holder adapter 30 includes an outer dimension that is configured for receipt within a cup holder. The adapter further comprises a mounting formation 32 that has a preferably convex mounting surface 34 but it may be configured in any type of suitable shape.

The adapter has an upper platform 36, at least one annular wall formation 38 depending downwardly from the upper platform 36, and a horizontally extending lower platform 40 at a lower edge of the annular wall formation 38. The mounting formation 32 extends upwardly from the lower platform 40. In this way, the mounting formation 32 is recessed below the height of the upper platform 36.

Figure 7B:
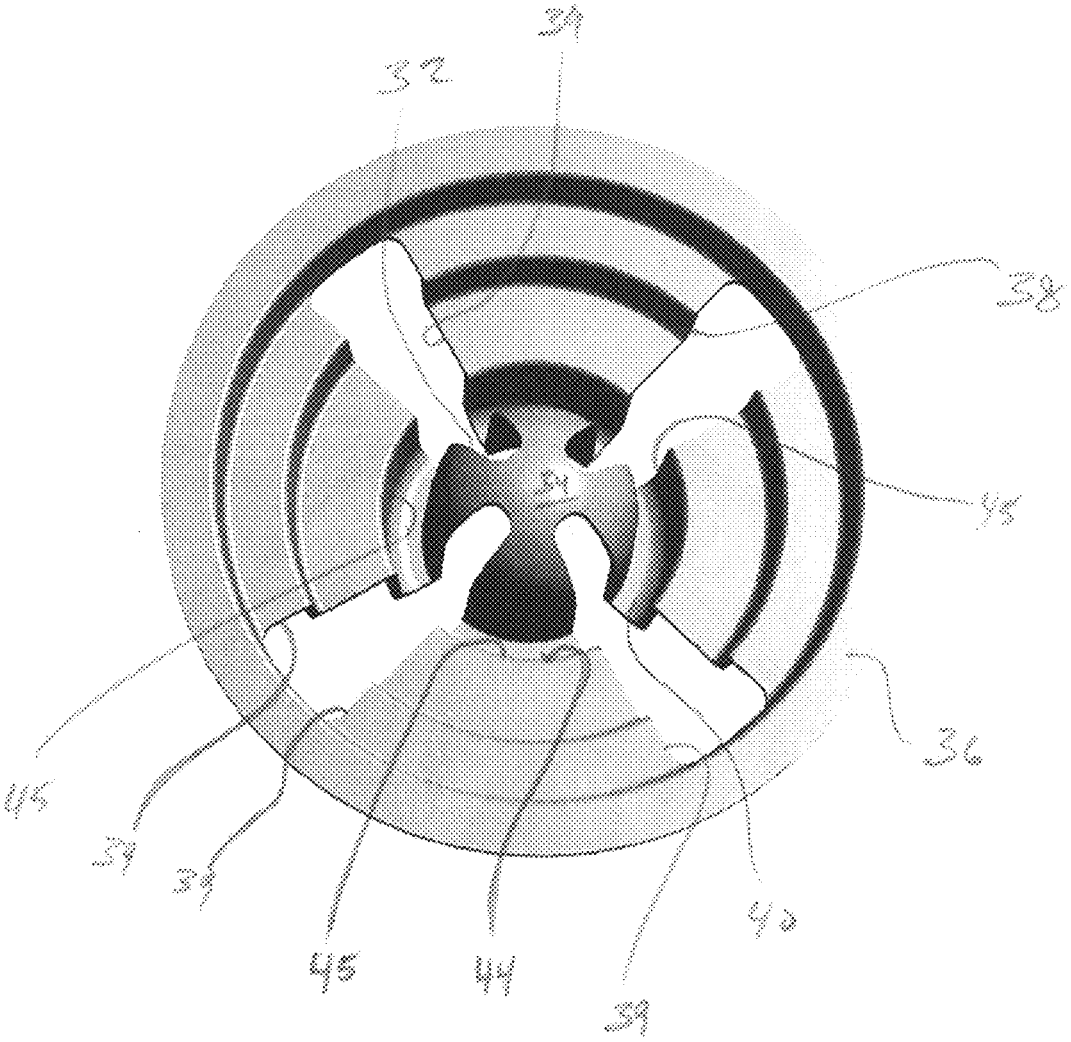
FIG. 7B is a perspective view of a second cup holder adapter.

FIG. 7B shows a second cup holder adapter 31 that is similar in structure to the first cup holder adapter 30 of FIG. 7A, except in FIG. 7B, there are cutouts defined in the annular wall formation 38 by cutout edges 39. A user could use the second cup holder adapter 31 in place of the first cup holder adapter 30. A manufacturer could provide the first embodiment of the cigar holder 10 with either of these cup holder adapters 30, 31.

To engage the convex mounting surface 34 of the adapter, a concave inner surface 42 is formed on the engagement member 14 to provide a frictional receiving seat. The concave inner surface 42 extends upwardly from a bottom edge 16 of the engagement member. The concave inner surface 42 defines a mounting recess that is accessible at the bottom edge 16 of the engagement member 14.

The mounting formation 32 can be selectively received within the mounting recess so that the concave inner surface 42 and the convex mounting surface 34 are in direct frictional engagement and are dimensioned as such where the concave mounting formation 32 is slightly larger than the seat provided by concave inner surface 42 to provide a frictional fit. This engagement between the concave inner surface 42 and the convex mounting surface 34 facilitates alignment of the engagement member 14 with the adapter 30 so that the engagement member 14 supports the base in a vertically upright manner as shown in FIGS. 5-6.

The adapter has a retention wall 44 at least partially encircling the convex mounting surface 34 when viewed from above. In FIG. 7A, the adapter 30 has a retention wall 44 that is formed as an annular wall (with the retention wall being the inner surface of the lower annular wall portion 43). In FIG. 7B, the retention wall 44 includes retention wall portions 45 that are spaced apart, and form arcs spaced apart from the mounting surface when viewed from above.

The convex outer surface 26 of the engagement member 14 and the retention wall 44 (or retention wall portions 45) are dimensioned so that they are in frictional engagement when the engagement member 14 is mounted on the adapter 30 or the adapter 31, as shown in FIGS. 5-6.

The cup holder adapter 30, 31 is preferably molded and conforms in size and dimension to any typical cup holder in a golf cart, a boat, a car, a truck, recreational vehicles and any automobile/vehicle having a cup holder, or other cup holder. The cup holder adapter 30,31 can include a mating slotted design open diameter configuration, which accepts the ball-like engagement member 14 of the holder 10 with a press fit design to insert and remove to separate the device 10 from the cup holder adapter.

Figure 8A:
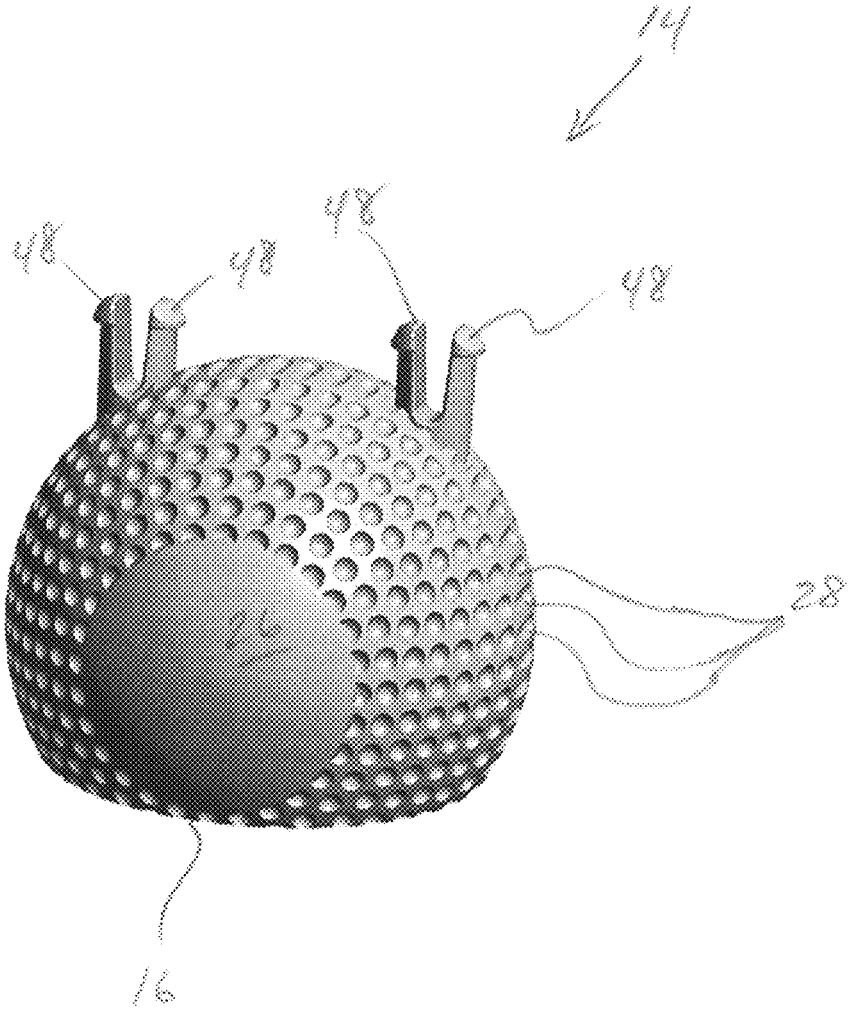
FIG. 8A is a perspective view of the engagement member installed in a base as in the exemplary embodiment.
Figure 8B:
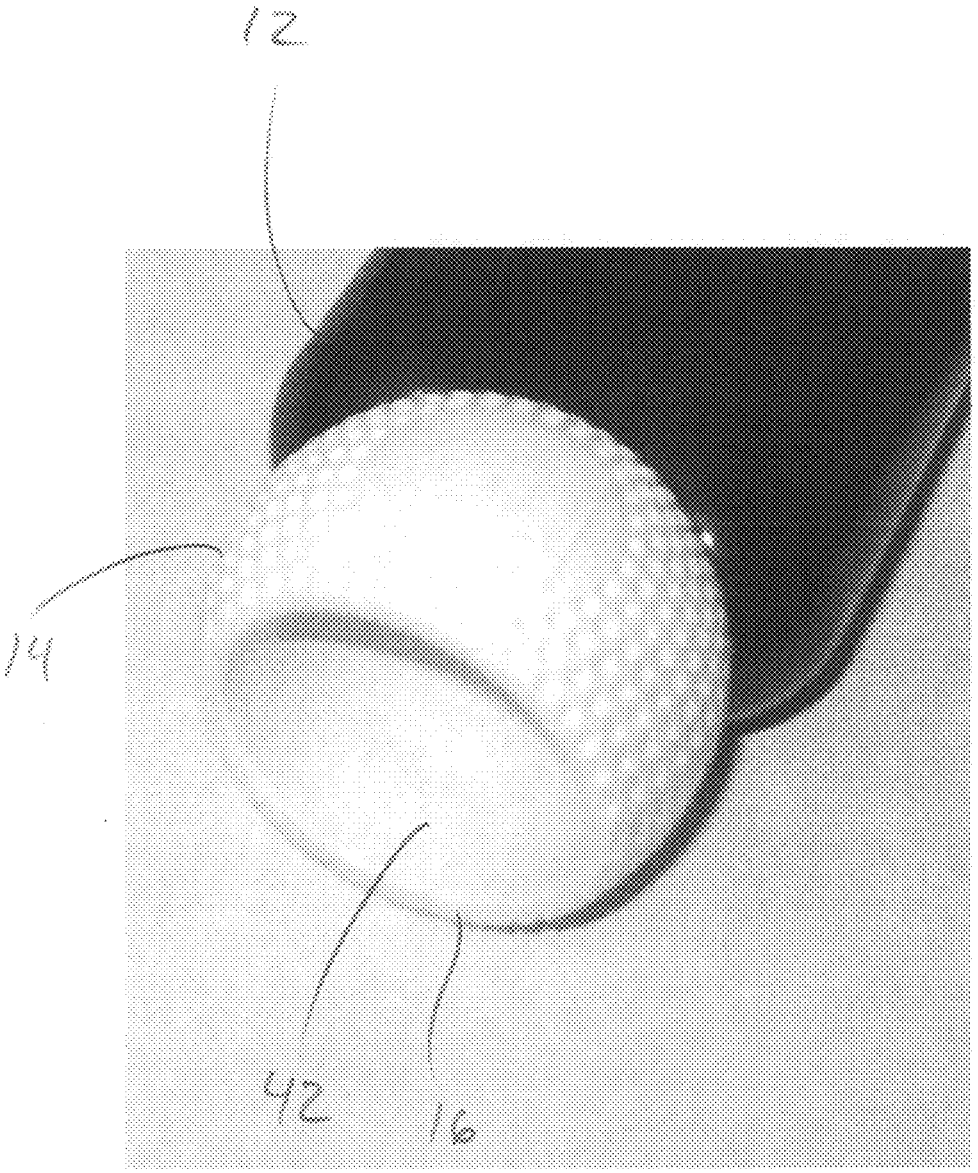
FIG. 8B is another perspective view thereof.

The engagement member 14 is shown in further detail in FIGS. 8A-8B. The engagement member 14 is preferably connected to the bottom of the base 12 by latches 48 on the engagement member 14 that engage latching recesses 50 defined on the lower surface 52 of the base 12. This is just one example of how the engagement member 14 can be secured to the base 12. The base 12 and engagement member may be separate parts that may be connected to each other in any way, such as shown in FIGS. 8A-8B. They may be connected in other ways, such as glue or adhesive. Further, they may be molded as a unitary body.

As discussed in more detail above, the engagement member 14 is dimensioned and configured to engage various support structures. In particular, the engagement member 14 is configured and arranged to be frictionally received in a ball tray 100 of a golf cart or in an adapter 30, 31 for a cup holder 200, 300 in a vehicle.

Figure 9A:
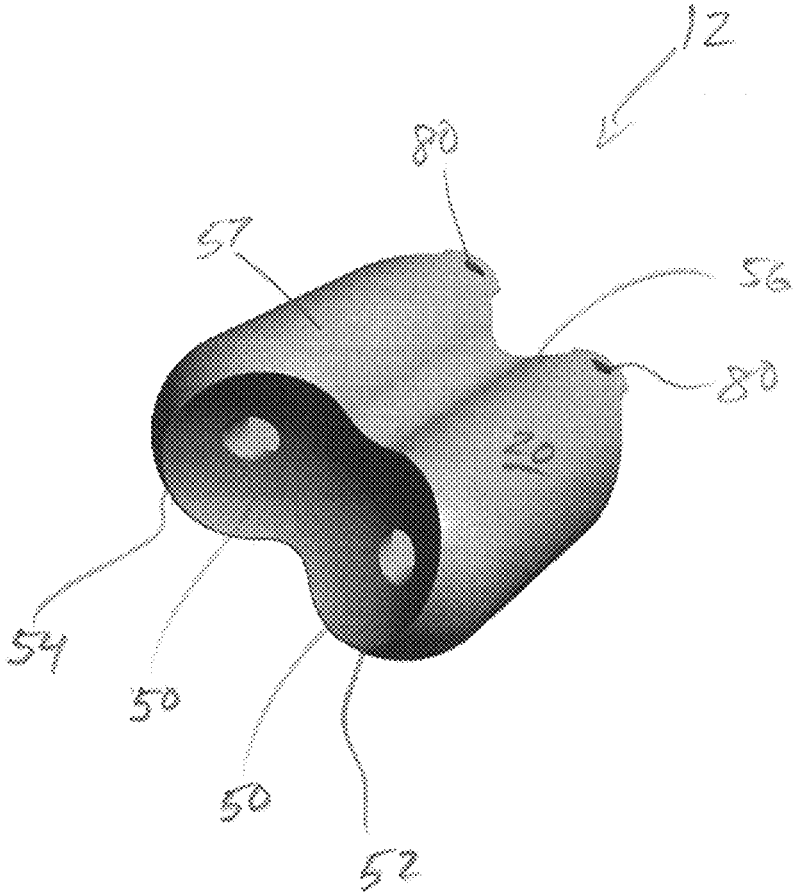
FIG. 9A is a perspective view of the base of the exemplary embodiment.
Figure 9B:
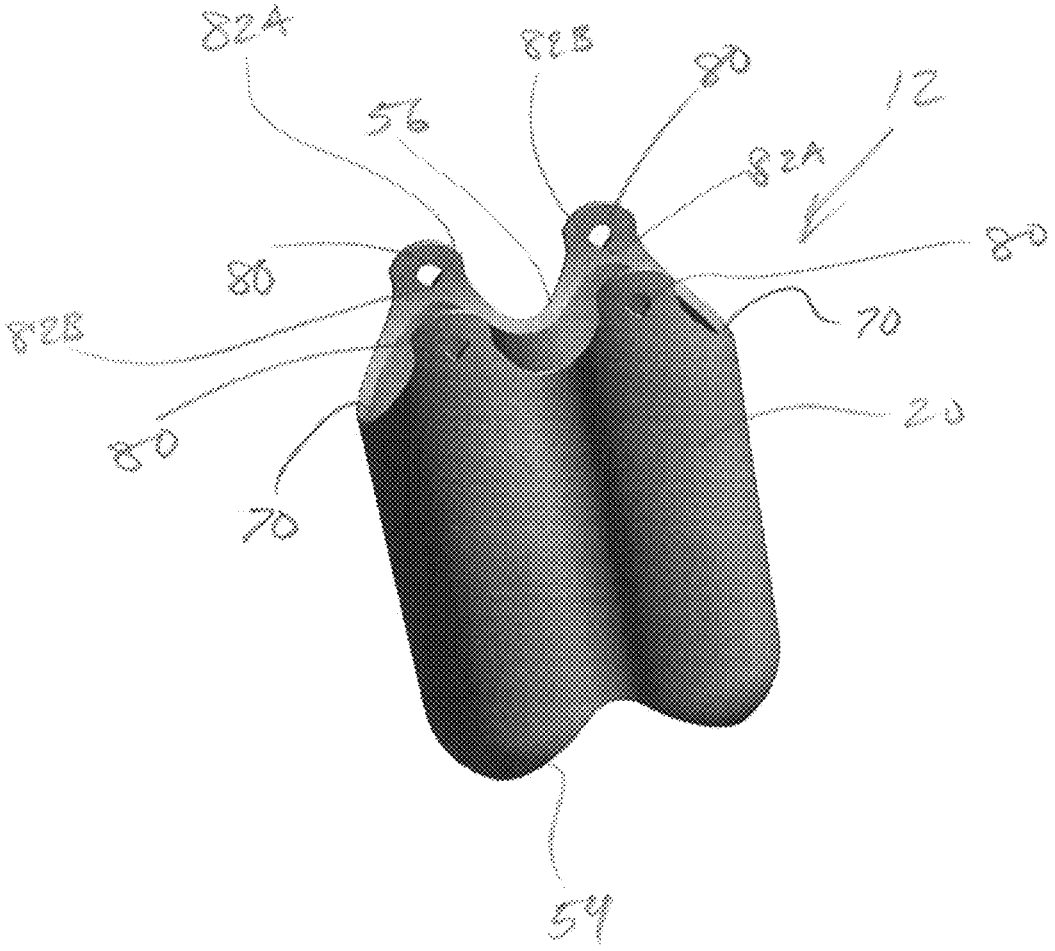
FIG. 9B is another perspective view thereof.

The exemplary embodiment cigar holder 10 of the present invention includes a base 12, which is shown in FIGS. 9A-9B. The base has a closed bottom end 54 with a lower surface 52 at the bottom end 54, a top open end 56, and an outer side wall 57 extending between the bottom end 54 and the top end 56.

The top open end 56, the closed bottom end 54, and the outer wall 57 of the base 12 define an ash receptacle for the user of the cigar holder 10 that is accessible when the cover 18 is removed from the base 12. When the engagement member 14 engages a support structure (such as a ball tray 100) so the base 12 extends at least substantially vertically, and when at least one tray 24A, 24B is moved to the horizontal open orientation, a user can place a cigar 11 on that support tray 24A, 24B so that a free end 13 of the cigar 11 having an ash resides over the top open end 56 of the base 12. In this way, the base 12 can receive any ash falling from the free end 13 of the cigar 11.

Figure 10:
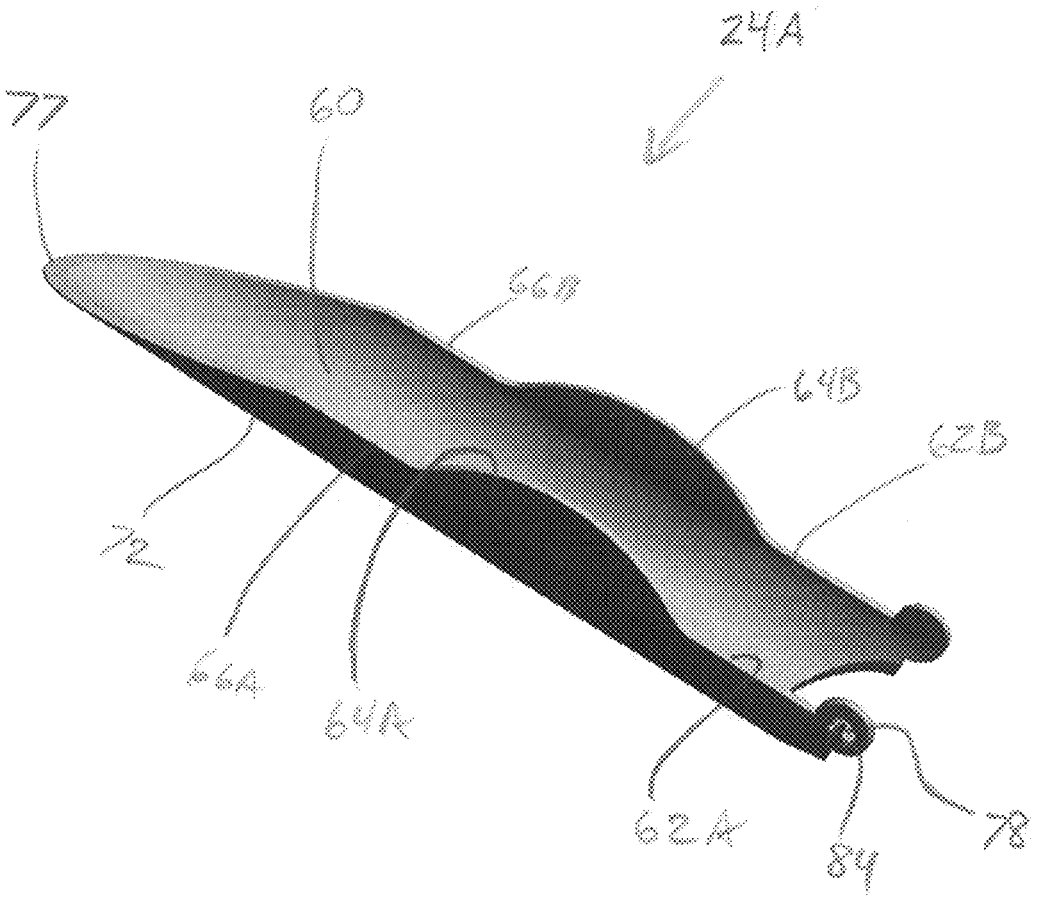
FIG. 10 is a perspective view of a support tray of the exemplary embodiment.

Turning to FIG. 10, each support tray 24A, 24B is configured to support a cigar 11. FIG. 10 shows a first support tray 24A, but it is to be understood that the two support trays 24A, 24B of the exemplary embodiment are at least substantially congruent. In the exemplary embodiment, each support tray 24A, 24B has a preferably concave tray surface 60 for supporting a cigar 11 thereon when the respective tray 24A, 24B is in the horizontal open orientation. When the tray 24A, 24B is rotated to the horizontal open orientation, the concave tray surface 60 is seen as the upper surface of the support tray 24A, 24B. The concave tray surface 60 can be formed with an at least substantially U-shaped or C-shaped cross section for at least a portion of its length. In the exemplary embodiment, the support tray 24A, 24B of FIG. 10 has a concave tray surface 60 that has a semicircular profile when viewed from the end.

The concave tray surface 60 extends between a first side 62A of the tray 24A, 24B to a second side 62B of the tray 24A, 24B.

To facilitate retention of a cigar 11 on the support tray 24A, 24B, and to decrease the likelihood that a user (or another source of an external force) would knock a cigar 11 off of the support tray 24A, 24B, each support tray 24A, 24B further comprises a pair of support walls 64A, 64B that extend vertically from each side 62A, 62B of the support tray 24A, 24B. When the respective tray is in the horizontal open orientation, as shown in FIGS. 3 and 6, a first edge 66A along the first side 62A of the tray 24A, 24B extends at least substantially horizontally, a second edge 66B along the second side 62B of the tray 24A, 24B extends at least substantially horizontally, the first support wall 64A extends upwardly from the first edge 66A, and the second support wall 64B extends upwardly from the second edge 66B.

The left and right support trays 24A, 24B incorporate a tapered tip end 77 to provide access to the cigar when placed in the tray at the 90° horizontal open orientation for operation.

The support trays 24A, 24B may be spring-biased to the open orientation, so that support surfaces 60 of the support trays 24A, 24B extend at least substantially horizontally. To prevent rotation of the support trays 24A, 24B beyond the horizontal open orientation, at least one stop surface 70 is formed on the base 12, with at least one stop surface 70 for respectively engaging each one of the support trays 24A, 24B. In the exemplary embodiment of the cigar holder 10, each tray 24 has an outer tray surface 72, and there are two stop surfaces 70, so that a first stop surface 70 is provided for directly engaging an outer tray surface 72 of the first tray 24A when the first tray 24A is in the horizontal open orientation and a second stop surface 70 is provided for directly engaging an outer tray surface 72 of the second tray 24B when the second tray 24B is in the horizontal open orientation.

The holder can include a "spring open" feature within the mechanical connection of the right and left support trays 24A, 24B to the base 12 design by utilizing a torsional spring in each linkage to have the tray "spring" open. The support trays 24A, 24B can be folded closed against the forces of the springs and then retained closed when the cover is placed thereover. Or, the support trays may freely pivotable to any position desired by the user.

In the exemplary embodiment of the cigar holder 10, two torsional springs (not shown) are provided. A first torsional spring has one end secured to the base 12 and the other end secured to the first support tray 24. The second torsional spring has one end secured to the base 12 and the other end secured to the second support tray 24. When the support trays 24 are in the vertical stored orientation, the torsional springs are held in tension so that the torsional spring applies forces to the base and to the respective support trays 24A, 24B to bias the support trays to rotate outwardly about the hinge 76. Other embodiments can rely on one or more springs to in other configurations to bias the support trays 24A, 24B to the horizontal open orientation.

Each support tray 24A, 24B is supported in the horizontal open orientation by the hinge 76 and by the contact between the respective outer tray surface 72 and the respective stop surface 70.

Because each tray is secured to the base only at the hinge 76, and because the center of mass of each tray 24 is located towards the tip end 77 of the respective tray 24A, 24B, when the base 12 extends vertically (such as when the base 12 is supported in a cup holder or in a ball tray as shown in FIGS. 3, 5, and 6) and when a user begins to rotate the support tray 24A, 24B away from the vertical closed orientation, the weight of the tray 24A, 24B itself facilitates rotation of the support tray 24A, 24B to the horizontal open orientation. Thus, other embodiments may omit the torsional springs and rely only on the weight of each support tray to maintain the respective support trays in the open orientation.

The support trays 24A, 24B have an integrated locking hinge mechanism/design molded into the bottom section. This allows for ease in assembly of the tray halves to the bottom of the device. Generally, a user would wish to have each support tray 24A, 24B in the vertical stored orientation for storage or in the horizontal open orientation for supporting at least one cigar 11 on/in the device 10. To stabilize the support trays 24A, 24B in these two orientations, the device 10 further includes a locking structure on the hinge 76. On each support tray 24, there is at least one hinge post 78 on the support tray, which is received in at least one respective hinge aperture 80 defined in the base 12. In the exemplary embodiment, each support tray has two hinge posts 78, each received in a respective hinge aperture 80 on the base. The locking structure includes a first locking recess 82A and a second locking recess 82B defined in each hinge aperture 80 in the base 12, and a locking protrusion 84 formed on each hinge post 78. When a support tray 24A, 24B is rotated to the vertical closed orientation, each hinge post 78 on that support tray is rotated so each locking protrusion 84 on that support tray 24 is received within the respective first locking recess 82A. When the support tray 24A, 24B is rotated to the horizontal open orientation, each hinge post 78 on that support tray 24 is rotated so each locking protrusion 84 on that support tray 24 is received within the respective second locking recess 82B. In the exemplary embodiment of the cigar holder 10, the locking protrusion 84 is formed as a convex surface, and the first and second locking recesses 82A,82B are formed as concave surfaces. The locking protrusion 84 extends beyond the outer diameter of the cylindrical portion of the respective hinge post 78.

Thus, each support tray 24A, 24B can be locked in the vertical closed orientation, and can be locked in the horizontal open orientation. In the exemplary embodiment, a user can lock each support tray independently of the other support tray. FIG. 5 shows how one support tray 24B is locked in the vertical closed orientation and the other support tray 24A is locked in the horizontal open orientation.

Figure 11:
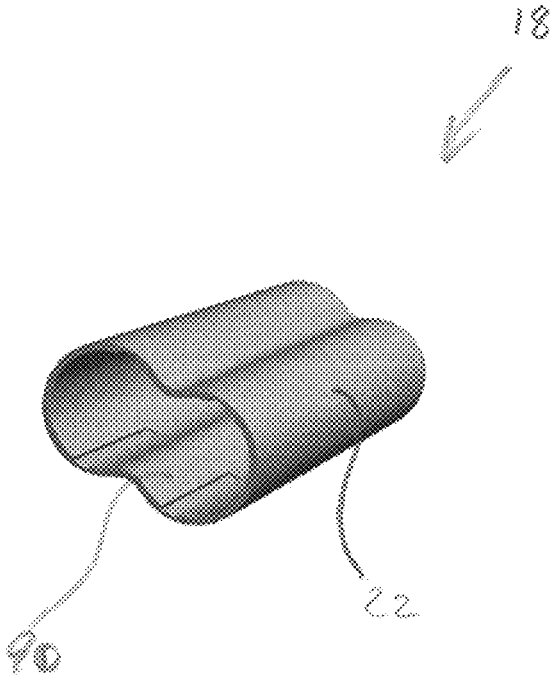
FIG. 11 is a perspective view of the cover of the exemplary embodiment.

As seen in FIG. 11, the cover 18 has an inner cover surface 90 that is capable of frictionally engaging an outer surface 20 of the base 12 when the cover 18 is received in a stored orientation on the base 12, as shown in FIG. 1.

Figure 12:
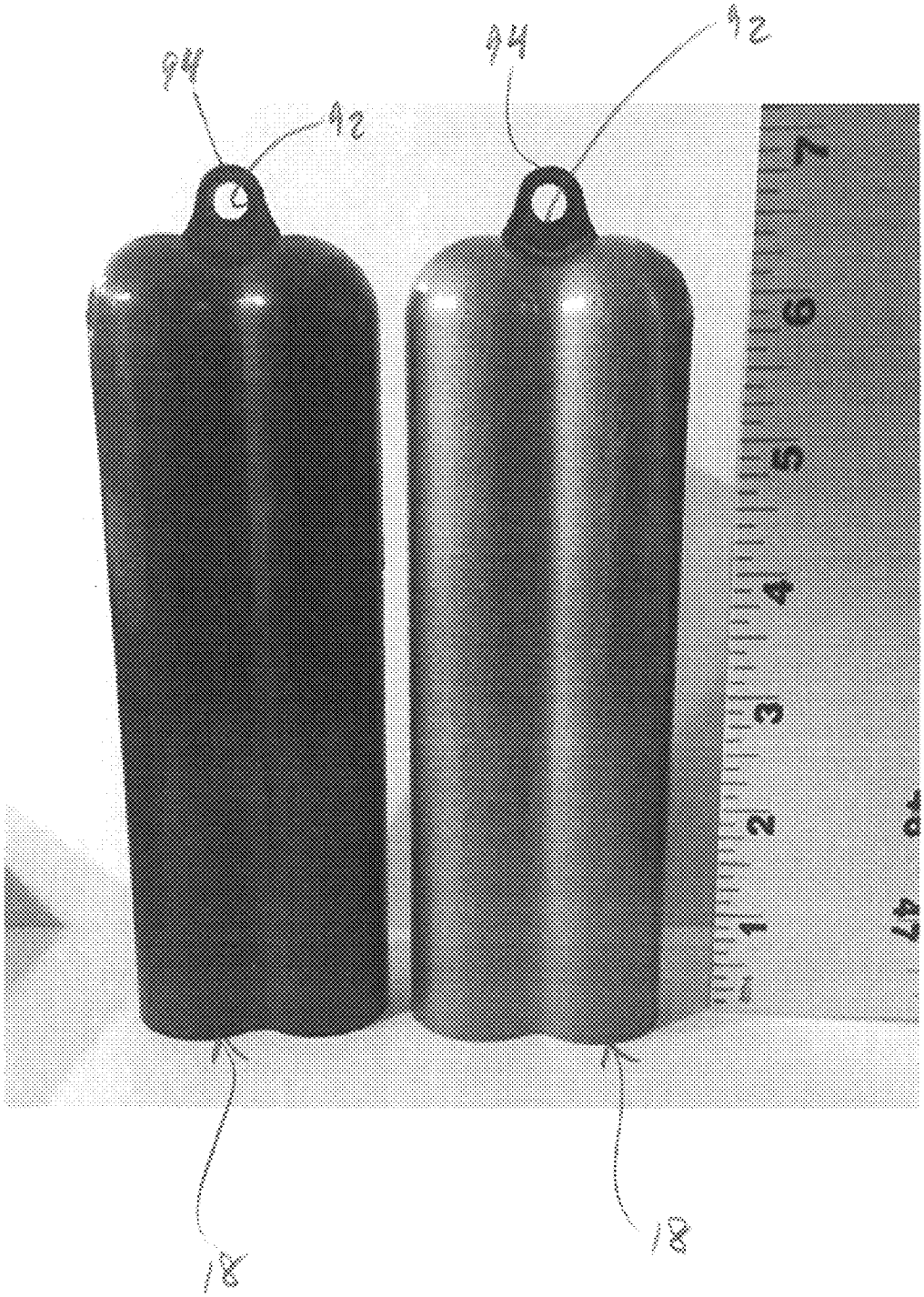
FIG. 12 shows a cover of the exemplary embodiment of the present invention.

FIG. 12 shows the cover 18 apart from the base 12. The cover has an accessory engaging aperture 92 defined at the upper end 94 of the cover 18 to enable the device 10 to be easily attached and detached to a golf bag or other structure (not shown) by a typical releasable clip or other detachable clip (not shown) that is commonly used for attaching accessories to a golf cart. Also, aperture 92 can be used to receive a key ring or a decorative accessory.

The base/ash tray receptacle 12 can be either molded or a metal design configuration incorporating the ability to hinge the support trays 24A, 24B on each side (multiple cotter pin type/spring design or integrated molded). The ball-like engagement member 14 is preferably made of high density material to provide the look & feel of an actual golf ball. This ball-like engagement member 14 also preferably includes a flat face of adequate weight (center of gravity) to allow the holder to free stand and also be utilized on a flat surface or sitting securely within any golf cart ball tray, as described above.

Figure 13:
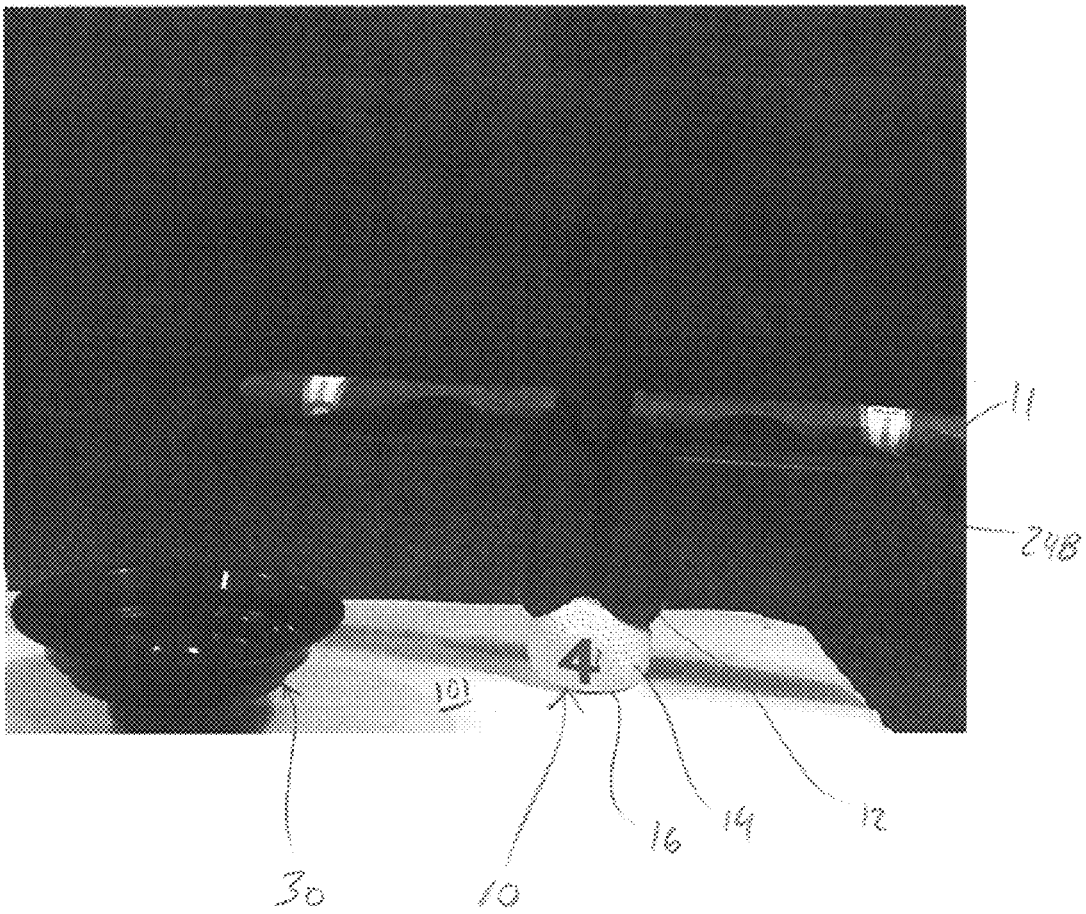
FIG. 13 a cigar holder of the present invention with both the support trays in an open orientation, and seated on a flat support surface without use of the adapter.

FIG. 13 shows an adapter 30 and a cigar holder 10 with the support trays 24A, 24B in the open orientation. FIG. 13 shows that the engagement member 14 has a flat bottom surface 16 that allows the cigar holder 10 to stand upright on a flat support surface 101.

It should be understood that the adapters shown and discussed herein are just examples of the type of adapters that can be employed herein to enable the device 10 of the present invention to be installed in a given location. Depending on the location for installation, the adapter can be modified as needed to accommodate that particular installation location and the configuration of the interface for the device itself can be modified accordingly. For example, instead of a ball-like configuration, a different shape may be used. Also, for example, instead of using an inner concave surface 42, other configurations may be used, such as a convex surface or outward emanating post (not shown). Such modified adapters and interfaces are considered to be within the scope of the present invention.

As can be seen in the Figures and understood from the above description, the support trays 24 of the holder 10 are useful for holding and supporting the cigars 11 when they are lit but not being smoked at the moment. For example, when smoking cigars while playing golf, it is well known that such cigars must be put down when swinging a golf club. Therefore, the holder 10 of the present invention provides an optimal way to store the cigar 11 when it is not being smoked. For example, when stored as in FIG. 3 with the ash end of the cigar 11 residing over the open base 12, any resulting ashes are captured in the base 12 of the holder 10, which serves as a receptacle ashtray. Also, like any ashtray, the base can be used to hold butt ends when smoking is concluded.

The holder 10 of the present invention can be created in any type of material. For example, it may include metal components or varying finishes, such as carbon fiber, wood grain, stainless steel, chrome, black metallic, aluminum, brass, and the like, to provide advanced design styles providing the same features and benefits of this device.

It would be appreciated by those skilled in the art that various changes and modifications can be made to the illustrated embodiments without departing from the spirit of the present invention. All such modifications and changes are intended to be covered by the appended claims.

What is claimed is:

1. A holder for an article to be smoked and having an ash, comprising:

a base with a closed bottom end, a top open end and side walls;

at least one support tray hingedly connected to the base; the at least one support tray being pivotable between a stored vertical closed orientation and a horizontal open orientation; the at least one support tray being substantially level with the ground when in the open orientation;

a cover positionable over and about the at least one support tray when the at least one support tray is in the stored vertical closed orientation;

an engagement member connected to the bottom of the base, which is configured and arranged to be frictionally received in a ball tray of a golf cart;

an adapter having an outer dimension configured for receipt within a cup holder, the adapter further comprising a mounting formation that has a convex mounting surface;

the adapter further comprising a retention wall at least partially encircling the convex mounting surface when viewed from above;

a concave inner surface formed on the engagement member, the concave inner surface extending upwardly from a bottom edge of the engagement member, and the concave inner surface defining a mounting recess accessible at the bottom edge of the engagement member;

a convex outer surface formed on the engagement member;

wherein the mounting formation can be selectively received within the mounting recess so that the concave surface and the convex mounting surface are in direct engagement;

wherein the convex outer surface and the retention wall are dimensioned so that they are in frictional engagement when the engagement member is mounted on the adapter; and whereby placing the article on the at least one support tray, a free end of the article having an ash resides over the open end of the base to receive any ash falling therefrom.

2. The holder of claim 1, wherein the adapter has an upper platform, an annular wall depending downwardly from the upper platform, a horizontally extending lower platform at a lower edge of the annular wall, and the mounting formation extends upwardly from the lower platform.

3. The holder of claim 1, wherein the engagement member further comprises:

a convex outer surface;

a plurality of dimples defined on the convex outer surface.

4. The holder of claim 1, wherein each support tray further comprises a concave tray surface for supporting a cigar thereon when the respective tray is in the horizontal open orientation;

the concave tray surface extending between a first side of the tray to a second side of the tray.

5. The holder of claim 4, each tray further comprising a first support wall extending from a first side of the tray and a second support wall extending from a second side of the tray, wherein when the respective tray is in the horizontal open orientation a first edge along the first side of the tray extends horizontally, a second edge along the second side of the tray extends horizontally, the first support wall extends upwardly from the first edge, and the second support wall extends upwardly from the second edge.

6. The holder of claim 1, further comprising:

an outer tray surface on each tray;

at least one stop surface formed on the base, each stop surface corresponding to a respective tray;

wherein when a respective one of the at least one trays is in the horizontal open orientation, the outer surface of the respective tray is in direct engagement with the respective stop surface.

7. The holder of claim 6, further comprising:

at least one spring connected to at least one of the at least one support trays and the base, so the respective support tray is spring biased to rotate to the horizontal open orientation with respect to the base.

8. The holder of claim 1, wherein the at least one support tray is two support trays.

9. The holder of claim 7, wherein the at least one support tray is a first support tray and a second support tray, and the at least one spring is a first spring and a second spring, the first spring being connected to the first tray and the base to spring bias the first tray to the horizontal open orientation, and the second spring being connected to the second tray and the base to spring bias the second tray to the horizontal open orientation.

10. The holder of claim 1, wherein the at least one support tray is a first support tray and a second support tray, and the at least one spring is connected to the first tray and the second tray to spring bias each tray to the horizontal open orientation.

11. The holder of claim 1, wherein each of the support trays is connected to the base by a respective a locking hinge, so that the at least one tray can be locked in the vertical closed orientation and can be locked in the horizontal open orientation.

12. The holder of claim 1, wherein the cover has an inner cover surface that is capable of frictionally engaging an outer surface of the base when the cover is received in a stored position on the base.

13. The holder of claim 1, wherein the cup holder adapter includes a plurality of receipt surfaces to respectively engage with a plurality of cup holders of different sizes.

14. The holder of claim 1, wherein the cover defines an aperture configured and arranged for receipt of a clip or decorative member thereto.

* * * * *